US007273313B2

(12) United States Patent
Surjaatmadja

(10) Patent No.: US 7,273,313 B2
(45) Date of Patent: Sep. 25, 2007

(54) MIXING DEVICE FOR MIXING BULK AND LIQUID MATERIAL

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 413 days.

(21) Appl. No.: 10/869,998

(22) Filed: Jun. 17, 2004

(65) Prior Publication Data

US 2005/0281133 A1 Dec. 22, 2005

(51) Int. Cl.
*B01F 7/00* (2006.01)

(52) U.S. Cl. ..... 366/168.1; 366/181.7

(58) Field of Classification Search ..... 366/164.1, 366/168.1, 170.1, 172.1, 172.2, 180.1, 181.7, 366/305

See application file for complete search history.

(56) References Cited

U.S. PATENT DOCUMENTS 952,808 A * 3/1910 Inglish ..... 366/305
1,483,742 A * 2/1924 Stevens ..... 554/175
4,386,855 A * 6/1983 Neal et al. ..... 366/169.1
5,046,855 A 9/1991 Allen et al.
5,205,647 A * 4/1993 Ricciardi ..... 366/328.2
5,538,341 A 7/1996 Padgett et al.
5,538,343 A * 7/1996 Tynan ..... 366/305
6,386,751 B1 * 5/2002 Wootan et al. ..... 366/170.3
6,454,457 B1 9/2002 Banse et al.
7,121,714 B2 * 10/2006 Parker Metcalfe et al. ..... 366/175.1
2005/0281133 A1 * 12/2005 Surjaatmadja ..... 366/168.1

FOREIGN PATENT DOCUMENTS

DE 19539120 C1 * 7/1997

* cited by examiner

*Primary Examiner*—Charles E. Cooley
(74) *Attorney, Agent, or Firm*—John W. Wustenberg; McAfee & Taft

(57) ABSTRACT

A mixing apparatus includes an outer housing, or pressurized chamber, and an inner housing rotatably disposed in the outer housing. A bulk material inlet is defined at the upper end of the inner housing. The outer housing has a liquid inlet for the introduction of liquid. The inner housing has a plurality of liquid inlet ports for receiving liquid from the inner housing. The bulk material and liquid are mixed in the rotatable inner housing and pass through an exit of inner housing into the pressurized chamber. The slurry then passes out of the pressurized chamber through an outlet in the pressurized chamber. A rotor is disposed in and is connected to the inner housing. Rotation of the rotor causes rotation of the inner housing.

23 Claims, 3 Drawing Sheets

MIXING DEVICE FOR MIXING BULK AND LIQUID MATERIAL

BACKGROUND

This invention relates generally to apparatus and methods for mixing and more particularly but not by way of limitation to apparatus and methods for introducing material into a pressurized chamber.

Well drilling and completion operations often require mixing, and sometimes on-site mixing of various substances, such as cement slurries, acids and fracturing gels and weighting drilling fluids. In general, a mixing system includes a tub, pumps and various monitoring and control equipment. Cement slurries must be pumped into wellbores for a variety of reasons, such as for example securing casing in a wellbore. The mixture of cement to be used in a particular well typically is required to have certain characteristics which make the mixture, referred to as a cement slurry, suitable for the downhole environment where it is to be used. The desired type of cement slurry must be accurately mixed and produced at the well location so that it can be pumped into the wellbore.

Prior art apparatus for creating cement slurries include a jet mixer which typically sprays water under pressure into a venturi tube where bulk cement is added. The water and bulk cement combine to form a cement slurry which is conveyed into a tube prior to pumping the slurry down a wellbore. Another prior art mixer is shown in U.S. Pat. No. 5,046,855 (the '855 patent), the disclosure of which is incorporated herein by reference in its entirety. The '855 patent discloses a mixer with a flat orifice plate and a flat valve plate which can be utilized to regulate water flow. The valve and orifice plates are positioned horizontally in the mixer so that water must be falling downwardly, which is the same direction as the direction of flow of cement, when it engages the valve and orifice plates.

Another mixing apparatus is shown in U.S. Pat. No. 5,538,341 (the '341 patent), the disclosure of which is incorporated herein by reference in its entirety. The apparatus shown therein discloses a mixing tube with a dry substance inlet, a mixed substances inlet and a liquid inlet. The patent discloses that a water metering valve is to be connected to the liquid upstream from the liquid inlet. U.S. Pat. No. 6,454,457, the disclosure of which is incorporated herein by reference in its entirety, discloses another mixing apparatus.

Such prior continuous mixing systems work well and have served and continue to serve useful purposes. However, while the prior art apparatus and methods provide satisfactory results, there is always a need for mixing devices which can provide improved efficiency and improved mixing. Likewise, there is a need for apparatus and methods that will allow the addition of a bulk material into a pressurized chamber wherein the material will be mixed with liquid and the resulting mixture will exit the pressurized chamber. This capability is especially important when the mixing device is a completely sealed system wherein the bulk material could be entered without emitting dust in the air. The present invention provides such an apparatus.

SUMMARY

The mixing apparatus of the current invention comprises an outer housing, or pressurized chamber, and an inner housing rotatably disposed in the outer housing. The outer housing has a liquid inlet for introducing liquid under pressure into the outer housing. A plurality of inlet ports are defined in the inner housing so that liquid introduced through the liquid inlet in the outer housing may be introduced into an interior of the inner housing through the liquid inlet ports. The plurality of liquid inlet ports also enables balancing of the rotating inner housing. The inner housing defines the bulk material inlet and has an exit. The bulk material inlet is preferably at about atmospheric pressure. Liquid entering the inner housing through the liquid inlet ports will be entering under a pressure higher than pressure at the bulk material inlet. Bulk material introduced through the bulk material inlet will mix with liquid in the inner housing as the inner housing rotates in the outer housing. A mixture, or slurry of the liquid and bulk material will pass through the inner housing exit into the pressurized chamber, or outer housing, and will exit the outer housing through an outlet which is likewise at a pressure greater than the pressure of the bulk material inlet, which may be atmospheric pressure.

A hub, or rotor is disposed in the inner housing. A plurality of vanes connect the inner housing to the rotor. The rotor has a shaft extending therefrom that is connected to a motor to rotate the rotor and thus to rotate the inner housing. The vanes are circumferentially spaced about the rotor and thus provide a pathway for bulk material, liquid or a mixture thereof to pass through the inner housing to the exit of the inner housing.

Bulk material introduced into the bulk material inlet will mix with liquids introduced through the inlet ports which are preferably spaced circumferentially about the inner housing. The configuration of the inner housing along with rotation of the inner housing will force or impel the mixture of the bulk material and the liquid toward the inner housing exit and into the pressurized chamber. Likewise, the mixture will be forced out of the apparatus through the outlet in the pressurized chamber.

The bulk material inlet is preferably at or about at atmospheric pressure while pressure at the liquid inlet in the outer housing and at the outlet in the outer housing exceeds atmospheric pressure. The rotation of the inner housing along with the configuration of the inner housing will prevent the bulk material and liquid in the apparatus from being forced out of the apparatus through the bulk material inlet and will cause the mixture of liquid and bulk material to be forced out of the apparatus through the outlet in the outer housing.

DETAILED DESCRIPTION

Figure 1:
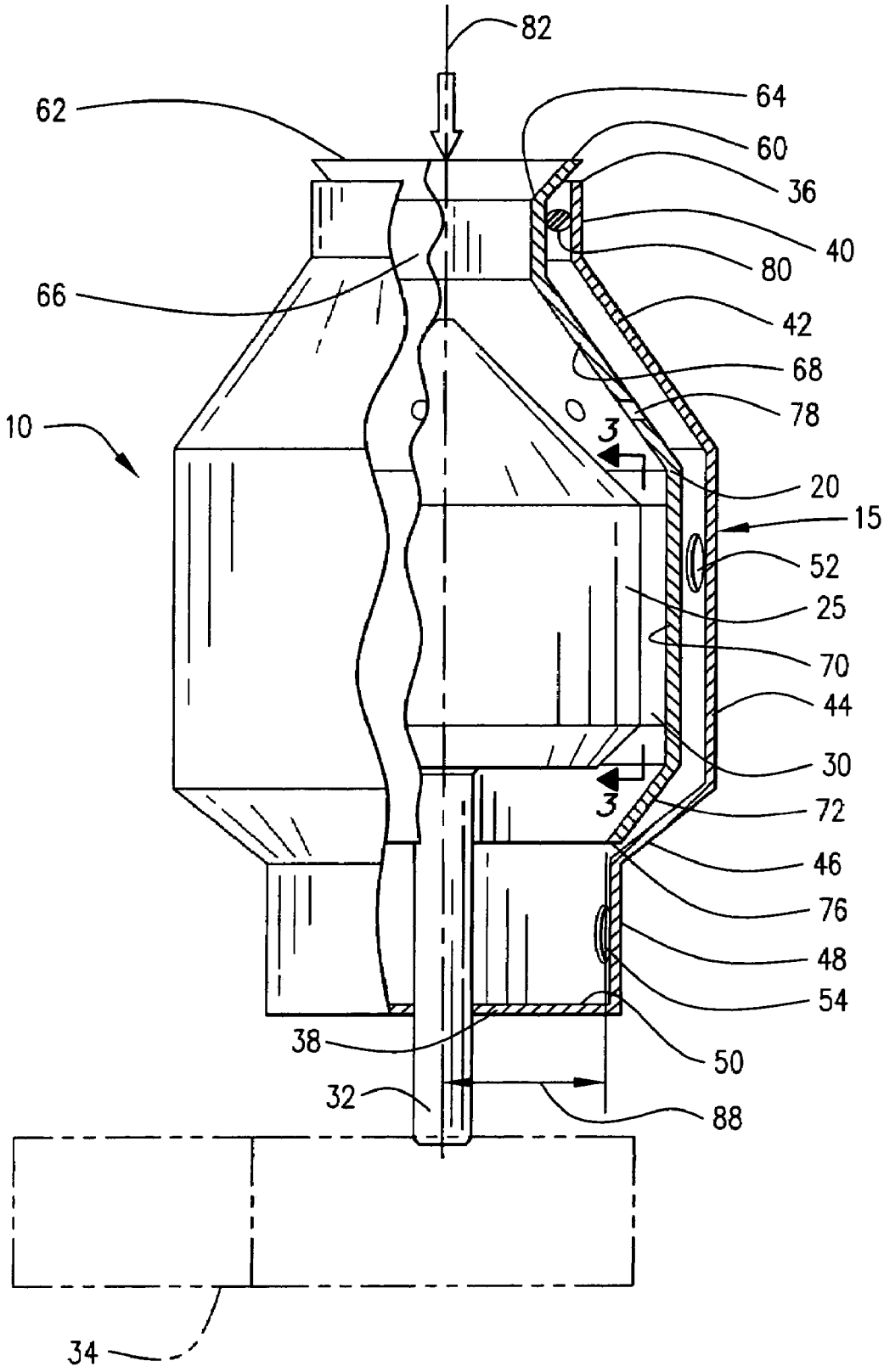
FIG. 1 is an elevation view of an apparatus of the current invention with a partial cutaway.

Referring now to the drawings and more particularly to FIG. 1, a mixing apparatus 10 is shown. Mixing apparatus 10 comprises a pressurized chamber or outer housing 15 and an inner housing 20. Inner housing 20 defines an inner housing interior 21, and is rotatably disposed in outer housing 15 and has a rotor 25 disposed therein. A plurality of vanes 30 connect rotor 25 to inner housing 20. Rotor 25 has a shaft 32 connected thereto that may be driven by a motor 34 or other means known in the art.

Outer housing, or pressurized chamber 15 has upper end 36 and lower end 38 that is a closed lower end 38. Although the terms upper end and lower end are utilized to describe the features of mixing apparatus 10, it will be understood that mixing apparatus 10, although preferably positioned vertically as is shown in the figures, may be positioned horizontally or at an angle between horizontal and vertical. Outer housing 15 has a generally cylindrically shaped upper portion 40, an upper sloping portion 42 that slopes radially outwardly from upper portion 40 to a central portion 44 that is preferably a generally cylindrical central portion 44, and a lower sloping portion 46 connected to central portion 44. Lower sloping portion 46 extends downwardly from central portion 44 and slopes radially inwardly therefrom. A lower chamber portion 48, which is preferably a generally cylindrical lower chamber portion 48 is connected to and extends downwardly from lower sloping portion 46. Upper housing 15 has a bottom 50 at lower end 38 thereof.

An inlet 52 is defined in outer housing 15 and is preferably defined in central portion 44. Inlet 52 is preferably a liquid inlet for the introduction of liquids under pressure therethrough. For example, depending upon the rotational velocity of the inner housing, liquids at a pressure of up to 50 psi may be introduced into outer housing 15 through inlet 52 which may be referred to as a liquid inlet 52. An outlet 54 is defined in outer housing 15. Outlet 54 may be referred to as a mixture or slurry outlet 54 in outer housing 15. As is apparent from the drawings, shaft 32 extends through bottom 50 and will be sealingly disposed through bottom 50. The seal between bottom 50 and shaft 32 may be achieved by any means known in the art.

Inner housing 20 is rotatably disposed in outer housing 15 and is spaced radially inwardly therefrom. Inner housing 20 has an opening 60, which may be referred to as bulk material inlet 60, at an upper end 62 thereof. Opening 60 may be referred to as a bulk material inlet or bulk material opening for the introduction of a bulk material such as, but not limited to, cement. Inner housing 20 has a lower end 63. Inner housing 20 tapers radially inwardly from the upper end 62 to form a funnel-shaped opening 60 having a lower end 64. A neck or generally cylindrical upper portion 66 is connected to and extends downwardly from funnel-shaped opening 60. An upper sloping portion 68 extends downwardly from upper portion 66 and slopes radially outwardly therefrom. A central portion, which is preferably a cylindrical central portion 70, extends downwardly from upper sloping portion 68. A lower sloping portion 72 extends downwardly from central portion 70 and slopes radially inwardly therefrom. Radially inner edge 74 is defined at a lower end 76 of lower sloping portion 72, which is the same as lower end 63. Lower end 63 defines an outlet, or exit 77.

Figure 3:
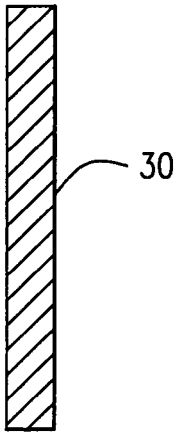
FIG. 3 is a section view taken from line 3-3 of FIG. 2.
Figure 3A:
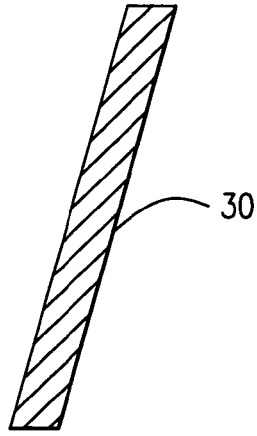
FIG. 3A is a section view of an alternative embodiment taken from line 3-3 of FIG. 2.

A plurality of liquid inlet ports 78 are spaced circumferentially around inner housing 20 and are preferably located in upper sloping portion 68. A seal 80 is disposed between outer housing 15 and inner housing 20 and sealingly engages both the inner housing 20 and outer housing 15. Seal 80 is preferably disposed in the annular space between upper cylindrical portion 66 of inner housing 20 and upper cylindrical portion 40 of outer housing 15. Inner housing 20 has a longitudinal axis 82 that may be referred to as a longitudinal central axis 82 which is also a longitudinal central axis of rotor 25. The longitudinal direction is referred to herein as the direction from top to bottom when the apparatus is in the vertical position as shown in the figures. Thus, liquid inlet ports 78 are positioned longitudinally between liquid inlet 52 in outer housing 15 and bulk material inlet 60. Vanes 30 can be vertical as shown in FIG. 3 or can be sloped as shown in FIG. 3A which will, as described in more detail hereinbelow encourage downward flow.

Rotor 25 has a tapered, or conically shaped upper or head portion 84 and a generally cylindrically shaped central portion 86 which is connected to vanes 30 which are as described hereinabove connected to inner housing 20. Vanes 30 are spaced circumferentially about central portion 86. The spacing of vanes 30 will allow flow through inner housing 20. Liquid inlet ports 78 may be positioned either slightly radially inwardly from radially inner edge 74 or may have a radially outermost position that is a distance 88 from central axis 82, which is the distance between longitudinal central axis 82 and the radially inner edge 74.

When mixing apparatus 10 is in operation, motor 34 will rotate in a direction to encourage downward flow. Bulk material opening 60 is preferably at atmospheric or ambient pressure. The pressure at liquid inlet 52 is higher than that at bulk material inlet opening 60 and may be 0 to 50 psi higher than the atmospheric pressure that exists at bulk material opening 60. Thus, liquid is injected through liquid inlet 52 under pressure and will be communicated into inner housing interior 21 through the plurality of liquid inlet ports 78. Bulk material is introduced through bulk material opening 60. The rotation of inner housing 20 and vanes 30 along with the configuration of inner housing 20 plus hydrostatic pressure causes a downward force so that pressure in pressurized chamber 15 does not force liquid and/or bulk material back out the upper opening 60. Upper sloping portion 68 during rotation of inner housing 20 will urge liquids such as but not limited to water and/or a mixture of liquid and bulk material, such as but not limited to cement downwardly. Thus, rotation of inner housing 20 creates a downward force on the liquid, or mixture in inner housing 20. The rotation of inner housing 20 causes the bulk material to mix with the liquid therein and also creates sufficient force so that the slurry or mixture will exit through outlet 54 in pressurized chamber 15.

Figure 2:
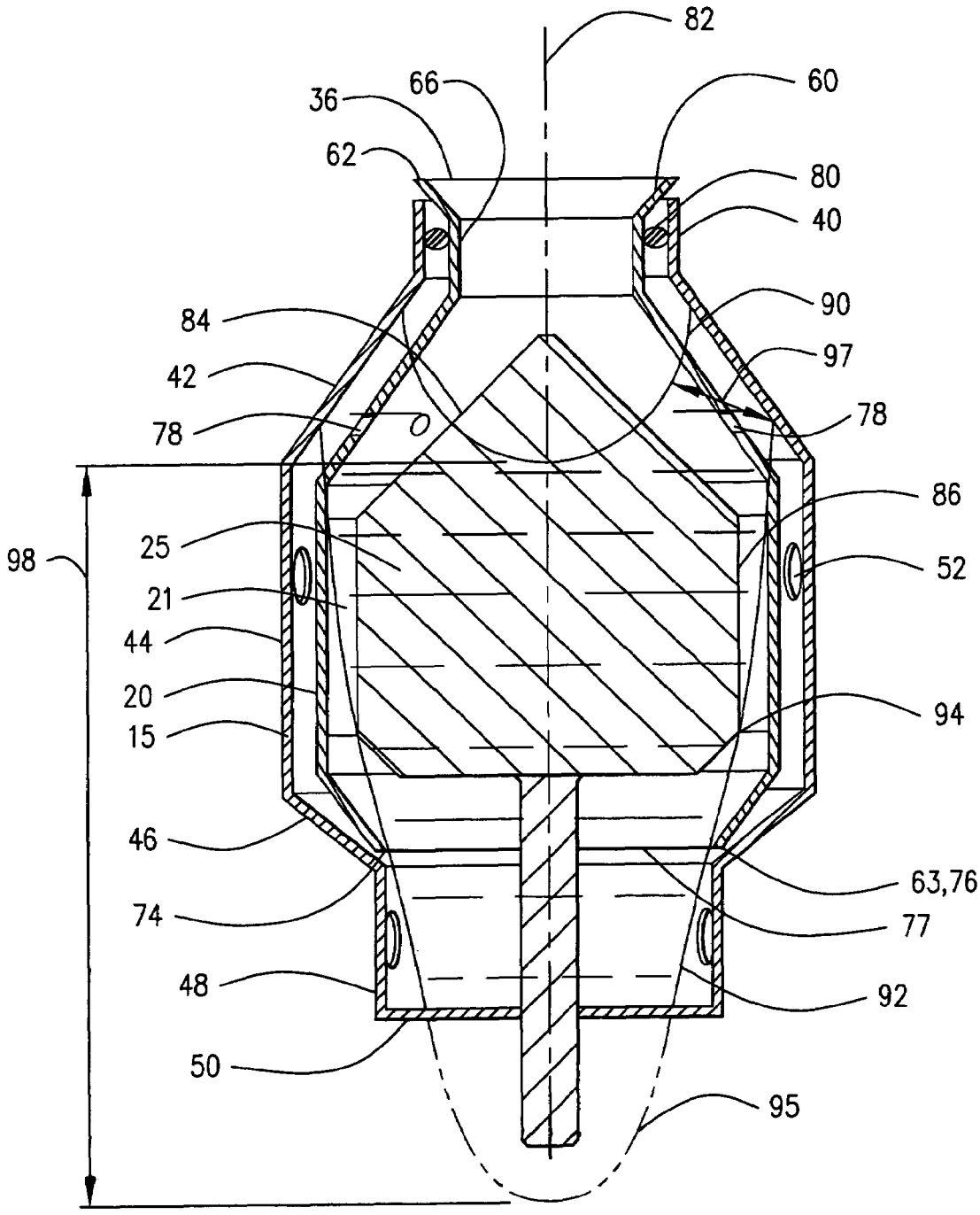
FIG. 2 is a cross-section view of the apparatus.

FIG. 2 has two lines designated lines 90 and 92. Line 92 indicates a minimum water level. Line 90 shows an operational water level. It is apparent from the drawings that when inner housing 20 is rotated and water and bulk material mixed therein, the mixture will take on a generally parabolic form. The inner assembly, namely the rotor 25 and inner housing 20 along with vanes 30 are rotated at a sufficient speed to create the desired radial and downward force. The speed with which inner housing 20 is rotated is also such that liquids, solids or slurries will form a block at the outside of the inner housing 20 thus blocking pressure from the bottom by means of the centrifugal force. In FIG. 2, line 92 is, as discussed earlier, the minimum slurry level. This minimum slurry level is defined as the fluid level that touches point 94. When this happens, no air can enter lower chamber portion 48 as it is being blocked at point 94, thus creating a pressure lock. Any liquid level higher than this line will then be pushed downward. Arrow 97 represents the "projected" distance of the two slurry surfaces on the upper portion of the device, and arrow 98 represents the imaginary vertical fluid level distance between the slurry level 90 and 92. Depending upon the rotational velocity, slurry level 92 could be substantially vertical and its parabolic bottom 95 could be located far below the bottom surface 96 of the system, making it imaginary. In other words, the parabolic bottom 95 is shown in the drawing below bottom 50 to reflect the parabolic shape that could occur in the absence of bottom 50. The slurry, or mixture, cannot be below bottom 50. The pressure that pushes downward on the line 92 would be the pressure of the liquid at inlet 52. This can be defined to be centrifugal g-force times the projected distance 97, or the vertical difference of the fluid level 98 times the gravitational force g which should be the same value. For water, pressure at 52 would be around 0.43*distance 98 [psi] or, if the fluid is a slurry already with a specific gravity of SG, then the pressure would be 0.43*SG*distance 98 [psi].

The current apparatus thus provides an apparatus and a method by which a bulk material may be introduced into a pressurized chamber or pressurized system. The bulk material may be introduced through bulk material opening 60 and mixed with a liquid and the mixture or slurry will exit from the pressurized chamber into which the bulk material is introduced.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A mixing apparatus comprising:

an outer housing having a liquid inlet;

an inner housing rotatably disposed in the outer housing;

a rotor disposed in and connected to the inner housing, wherein the rotor is spaced from the inner housing; and a plurality of vanes connecting the rotor to the inner housing;

wherein:

the inner housing has a bulk material inlet for bulk material;

the inner housing has an inner housing exit;

the inner housing defines a plurality of liquid inlet ports;

bulk material is introduced into the inner housing through the bulk material inlet as the inner housing is rotated relative to the outer housing;

liquid is communicated into the inner housing through the liquid inlet in the outer housing and the liquid inlet ports in the inner housing; and the liquid mixes with the bulk material in the inner housing.

2. The mixing apparatus of claim 1 wherein a mixture of the bulk material and the liquid passes through the inner housing exit and exits the apparatus through an outlet in the outer housing.

3. The mixing apparatus of claim 1 wherein the liquid inlet ports are spaced circumferentially about the inner housing.

4. The mixing apparatus of claim 1 wherein the liquid inlet ports are positioned longitudinally between the bulk material inlet and the liquid inlet in the outer housing.

5. The mixing apparatus of claim 1 wherein the inner housing and the outer housing are spaced apart radially.

6. The mixing apparatus of claim 5 further comprising a sealing element positioned between the inner housing and the outer housing, wherein the sealing element is positioned longitudinally between the liquid inlet in the outer housing and the bulk material inlet.

7. The mixing apparatus of claim 1 further comprising a shaft connected to the rotor, wherein the shaft is rotated by a motor.

8. The mixing apparatus of claim 1 wherein the rotor comprises a generally conically shaped head portion.

9. The mixing apparatus of claim 1 wherein the bulk material inlet is exposed to about atmospheric pressure, and a pressure at the liquid inlet in the outer housing exceeds the pressure at the bulk material inlet.

10. The mixing apparatus of claim 9 wherein a pressure at the outlet in the outer housing exceeds the pressure at the bulk material inlet.

11. The mixing apparatus of claim 9 wherein rotation of the inner housing urges a mixture of the liquid and the bulk material in the inner housing towards the outlet in the outer housing.

12. A mixing apparatus comprising:

a rotatable housing disposed in a pressurized chamber having a material inlet through which material is introduced, wherein the material inlet is exposed to atmospheric pressure, and wherein the rotatable housing has a sloping portion that slopes radially outwardly from the material inlet; and a plurality of liquid inlet ports defined in the rotatable housing and spaced circumferentially about the sloping portion of the rotatable housing for communicating liquid at a pressure exceeding atmospheric pressure into the rotatable housing, wherein the liquid and the material are mixed in the rotatable housing, and the mixture exits the rotatable housing into the pressurized chamber.

13. The mixing apparatus of claim 12 further comprising a rotor connected to the rotatable housing for rotating the rotatable housing.

14. The mixing apparatus of claim 13 wherein the rotor has a generally conically shaped head portion.

15. The mixing apparatus of claim 13 further comprising a plurality of vanes connecting the rotor to the rotatable housing.

16. The mixing apparatus of claim 15 wherein the vanes are sloped relative to a central axis of the rotor.

17. The mixing apparatus of claim 12 wherein rotation of the rotatable housing creates a centrifugal force which creates a pressure sufficient to pressurize the mixture through an outlet in the pressurized chamber.

18. A mixing apparatus comprising:

a pressurized chamber with a liquid inlet and an outlet, wherein liquid may be introduced into the pressurized chamber through the liquid inlet;

a rotatable housing disposed in the pressurized chamber;

a rotor disposed in the rotatable housing; and a plurality of vanes connecting the rotor to the rotatable housing;

wherein:

the rotatable housing has a bulk material inlet for receiving bulk material;

the rotatable housing has a plurality of liquid inlet ports for receiving liquid from the pressurized chamber;

the bulk material and liquid are mixed in the rotatable housing; and the mixture of bulk material and liquid passes through an exit in the rotatable housing into the pressurized chamber.

19. The mixing apparatus of claim 18 wherein the bulk material inlet is at about atmospheric pressure.

20. The mixing apparatus of claim 18 wherein the rotation of the rotating housing forces the mixture into the pressurized chamber and through an outlet in the pressurized chamber.

21. A mixing apparatus comprising:

a rotatable housing disposed in a pressurized chamber having a material inlet through which material is introduced, wherein the material inlet is exposed to atmospheric pressure;

a rotor connected to the rotatable housing for rotating the rotatable housing;

a plurality of vanes connecting the rotor to the rotatable housing; and a plurality of liquid inlet ports defined in the rotatable housing for communicating liquid at a pressure exceeding atmospheric pressure into the rotatable housing, wherein the liquid and the material are mixed in the rotatable housing, and the mixture exits the rotatable housing into the pressurized chamber.

22. The mixing apparatus of claim 21 wherein the rotor has a generally conically shaped head portion.

23. The mixing apparatus of claim 22 wherein the vanes are sloped relative to a central axis of the rotor.

* * * * *